US010605191B2

(12) United States Patent
Hauser et al.

(10) Patent No.: US 10,605,191 B2
(45) Date of Patent: Mar. 31, 2020

(54) PRECISE DETERMINING OF THE INJECTION QUANTITY OF FUEL INJECTORS

(71) Applicant: Continental Automotive GmbH, Hannover (DE)

(72) Inventors: Christian Hauser, Lappersdorf (DE); Gerd Roesel, Regensburg (DE); Markus Stutika, Regensburg (DE)

(73) Assignee: Vitesco Technologies GmbH, Hannover (DE)

( * ) Notice: Subject to any disclaimer, the term of this patent is extended or adjusted under 35 U.S.C. 154(b) by 19 days.

(21) Appl. No.: 15/937,372

(22) Filed: Mar. 27, 2018

(65) Prior Publication Data

US 2018/0216560 A1 Aug. 2, 2018

Related U.S. Application Data

(63) Continuation of application No. PCT/EP2016/074153, filed on Oct. 10, 2016.

(30) Foreign Application Priority Data

Oct. 12, 2015 (DE) ..... 10 2015 219 741

(51) Int. Cl.
*F02D 41/20* (2006.01)
*F02D 41/30* (2006.01)
*F02D 41/14* (2006.01)

(52) U.S. Cl.
CPC ..... *F02D 41/20* (2013.01); *F02D 41/3005* (2013.01); *F02D 2041/143* (2013.01);
(Continued)

(58) Field of Classification Search
CPC ..... F02D 41/20; F02D 41/3005; F02D 2041/2062; F02D 2041/143;
(Continued)

(56) References Cited

U.S. PATENT DOCUMENTS 5,979,803 A * 11/1999 Peters ..... F02M 47/046 239/533.2
5,988,142 A * 11/1999 Klopfer ..... F02M 47/027 123/446
(Continued)

FOREIGN PATENT DOCUMENTS

DE 19834405 A1 2/2000
DE 102005032087 A1 1/2007
(Continued)

OTHER PUBLICATIONS

Korean Office Action dated May 3, 2019 for corresponding Korean Patent Application No. 10-2018-7013370.
(Continued)

*Primary Examiner* — Joseph J Dallo

(57) ABSTRACT

A method for determining an injection quantity of a fuel injector determines a first time at which an injection process of the fuel injector starts, a second time at which the injection process of the fuel injector ends, calculates a model on the basis of the first time and the second time, which model represents the position of a nozzle needle of the fuel injector as a function of the time, and calculates the quantity of fuel to inject.

21 Claims, 4 Drawing Sheets

(52) U.S. Cl.
CPC ..... *F02D 2041/1437* (2013.01); *F02D 2041/2055* (2013.01); *F02D 2041/2062* (2013.01); *F02D 2200/063* (2013.01); *F02D 2200/0616* (2013.01)

(58) Field of Classification Search
CPC ..... F02D 2200/0616; F02D 2041/2055; F02D 2041/1437; F02D 2200/063
See application file for complete search history.

(56) References Cited

U.S. PATENT DOCUMENTS 6,236,910 B1 * 5/2001 Iwai ..... F02D 41/26 123/480
6,279,843 B1 * 8/2001 Coldren ..... F02M 47/027 239/585.1
6,354,270 B1 * 3/2002 Shafer ..... F02M 37/06 123/446
7,111,614 B1 * 9/2006 Coldren ..... F02M 45/02 123/299
2003/0089332 A1 * 5/2003 Yomogida ..... F02D 41/20 123/299
2004/0025849 A1 * 2/2004 West ..... F02D 41/3836 123/480
2004/0055576 A1 * 3/2004 McCarthy, Jr. ..... F02D 41/0087 123/458
2006/0090733 A1 * 5/2006 Fujii ..... F02D 41/2438 123/446
2010/0100303 A1 * 4/2010 Yuzaki ..... F02D 41/062 701/103
2011/0048379 A1 * 3/2011 Sommars ..... F02M 47/027 123/456
2011/0253105 A1 * 10/2011 Kim ..... F02M 47/027 123/445
2012/0016563 A1 * 1/2012 Ohsaki ..... F02D 41/221 701/102
2012/0022740 A1 * 1/2012 Ohsaki ..... F02D 41/0235 701/33.9
2013/0197837 A1 8/2013 Rosel
2013/0306034 A1 * 11/2013 Hamedovic ..... F02D 41/221 123/478
2015/0040869 A1 * 2/2015 Filippi ..... F02M 65/005 123/472
2015/0068494 A1 * 3/2015 Robart ..... F02D 41/2467 123/445
2015/0128913 A1 * 5/2015 Parisi ..... F02D 41/20 123/490
2015/0226148 A1 * 8/2015 Beer ..... F02D 41/247 123/480
2016/0215708 A1 * 7/2016 Nieddu ..... F02D 41/2467
2018/0017010 A1 * 1/2018 Nieddu ..... F02D 41/3872

FOREIGN PATENT DOCUMENTS

DE 69935826 T2 12/2007
DE 102010041880 A1 4/2012
DE 102013211469 A1 12/2014
DE 102013226849 B3 4/2015
EP 1443198 B1 8/2008
EP 1617065 B1 11/2012
EP 2650518 A1 10/2013
EP 303029309 A1 6/2016
JP 2000054897 A 2/2000
KR 20130115269 A 10/2013

OTHER PUBLICATIONS

International Search Report and Written Opinion dated Jan. 23, 2017 from corresponding International Patent Application No. PCT/EP2016/074153.
Office Action dated May 25, 2016 from corresponding German Patent Application No. 10 2015 219 741.7.
Korean Notice of Allowance dated Jul. 23, 2019 for corresponding Korean Patent Application No. 10-2018-7013370.

* cited by examiner

PRECISE DETERMINING OF THE INJECTION QUANTITY OF FUEL INJECTORS

CROSS REFERENCE TO RELATED APPLICATIONS

This application claims the benefit of PCT Application PCT/EP2016/074153, filed Oct. 10, 2016, which claims priority to German Application DE 10 2015 219 741.7, filed Oct. 12, 2015. The disclosures of the above applications are incorporated herein by reference.

BACKGROUND

The present invention relates to the technical field of actuating fuel injectors. In particular, the present invention relates to a method for determining an injection quantity of a fuel injector, having a solenoid drive, for an internal combustion engine of a motor vehicle. The present invention also concerns a method for actuating a fuel injector having a solenoid drive, wherein the actuation is based on an injection quantity determined according to the invention. The present invention furthermore relates to an engine controller and to a computer program which are designed to carry out the method according to the invention.

In order to inject fuel into a combustion chamber, such as a cylinder for example, a fuel injector such as, for example, a solenoid valve or a solenoid injector may be used. A solenoid injector (also called a coil injector) of this kind has a coil which generates a magnetic field when current flows through the coil, as a result of which a magnetic force is exerted on an armature so that the armature moves in order to cause opening or closing of a nozzle needle or of a closure element for opening or closing the solenoid valve. If the solenoid valve or the solenoid injector has a so-called idle stroke between the armature and the nozzle needle, or between the armature and the closure element, a movement of the armature does not also lead to a movement of the closure element or the nozzle needle immediately, but rather only after a movement of the armature by the magnitude of the idle stroke has been completed.

When a voltage is applied to the coil of the solenoid valve, electromagnetic forces move the armature in the direction of a pole piece or pole shoe. After overcoming the idle stroke, the nozzle needle or the closure element likewise move owing to mechanical coupling (e.g. mechanical contact) and, with a corresponding shift, opens injection holes for the supply of fuel into the combustion chamber. If current further flows through the coil, the armature and nozzle needle or closure element continue to move until the armature reaches or stops against the pole piece. The distance between the stop of the armature on a carrier of the closure element or the nozzle needle and the stop of the armature on the pole piece is also called the needle stroke or working stroke. In order to close the fuel injector, the exciter voltage which is applied to the coil is switched off and the coil is short-circuited, so that the magnetic force is dissipated. The coil short-circuit causes a reversal of polarity of the voltage owing to the dissipation of the magnetic field which is stored in the coil. The level of the voltage is limited by a diode. The nozzle needle or closure element, including the armature, is moved to the closing position owing to a return force which is provided, for example, by a spring. The idle stroke and the needle stroke are run in reverse order here.

For short injection times, the closing process begins even before the armature has stopped on the pole piece, so the needle movement thus describes a ballistic trajectory.

The time of starting the needle movement on opening of the fuel injector (also known as OPP1) corresponds to the start of the injection, and the time of ending the needle movement on closing of the fuel injector (also known as OPP4) corresponds to the end of the injection. These two times therefore determine the hydraulic duration of the injection. Consequently, for identical electrical actuation, injector-specific temporal variations for the start of the needle movement (opening) and the end of the needle movement (closing) can lead to different injection quantities.

According to the prior art, the injection quantity is frequently estimated by multiplying the hydraulic duration by an assumed constant through flow rate. In the event of short injection times, for example in conjunction with multiple injections, in particular in cases in which the needle movement describes a ballistic trajectory, such estimations cannot ensure the necessary precision to be able to set a uniform injection by a plurality of fuel injectors.

SUMMARY

The present invention is based on the object of making available an improved method for the precise determination of the injection quantity of a fuel injector.

This object is achieved by the subjects of the independent patent claims. Advantageous embodiments of the present invention are described in the dependent claims.

According to a first aspect of the invention, a method for determining an injection quantity of a fuel injector, having a solenoid drive, for an internal combustion engine of a motor vehicle is described. The described method comprises the following: (a) determining a first time at which an injection process of the fuel injector starts, (b) determining a second time at which the injection process of the fuel injector ends, (c) calculating a model on the basis of the first time and the second time, which model represents the position of a nozzle needle of the fuel injector as a function of the time, and (d) calculating the injection quantity on the basis of the model and a relationship between the position of the nozzle needle and the through low rate through the fuel injector.

The described method is based on the realization that precise determination of the injection quantity can be carried out on the basis of a model which represents the position of the nozzle needle as a function of the time, and a relationship between the position of the nozzle needle and the through flow rate through the fuel injector. In other words, the movement of the nozzle needle during the injection process is modelled and taken into account together with the through flow rate which is dependent thereon. The position of the nozzle needle and the geometry of the nozzle holes determine the size of the opening of the fuel injector and therefore (together with other parameters such as pressure, temperature etc.) the instantaneous through flow rate through the fuel injector.

In this document, "injection process" denotes, in particular, the part of the actuation of a fuel injector in which fuel is actually injected.

In this document, "model" denotes, in particular, a mathematical model which represents a behavior of a physical system.

In this document, "injection quantity" denotes, in particular, the entire fuel quantity which is injected or output during an individual injection process, that is to say between the first time and the second time.

The determination of the first time (start of the injection, also referred to as OPP1) and of the second time (end of the injection, also referred to as OPP4) can be carried out in different ways with known methods according to the prior art, for example on the basis of the eddy-current-operated coupling between the mechanism and the magnetic circuit which generates a feedback signal which is based on the movement of the mechanism. A speed-dependent eddy current is induced in the armature because of the movement of the nozzle needle and the armature, which also causes a feedback on the electromagnetic circuit. Depending on the movement speed, a voltage is induced in the solenoid which is superposed on the actuation signal.

The determination of the times and the calculations of the model and injection quantity can advantageously take place in an engine control unit using suitable numerical methods.

According to one exemplary embodiment of the invention, the model has a first parameter and a second parameter, wherein the first parameter is assigned to a linear part of the function, and the second parameter is assigned to a quadratic part of the function.

In other words, the model has a polynomial function of the second (2nd) order which represents or approximates the position of the nozzle needle as a function of the time.

According to a further exemplary embodiment of the invention, the first parameter of the model is calculated on the basis of predetermined data, in particular simulation data, and the first time.

In other words, data which has been stored in advance, for example simulation data which represents a relationship between the first parameter and the first time, for example in the form of a table, is used. The simulation data can be produced, for example, using finite element methods (FEM).

According to a further exemplary embodiment of the invention, the second parameter is calculated on the basis of the first parameter and at least one of the first time and the second time.

In other words, in order to determine the second parameter, the first parameter which has already been previously determined is used together with the first and/or second time. In particular, use can be made here of the fact that the function is to produce a predictable value such as, for example, zero, at the first and/or second time.

According to a further exemplary embodiment of the invention, the model has the function $$y(t) = v_{y0} \cdot t - \frac{1}{2} \cdot g \cdot t^2,$$

wherein y(t) denotes the position of the nozzle needle, $v_{y0}$ denotes the first parameter, g the second parameter and t the time.

The model consequently has a function y(t) which represents a general movement equation with an initial speed $v_{y0}$ and constant acceleration (forces) g. The first parameter $v_{y0}$ is therefore influenced, in particular, by the idle stroke, magnetic force, spring force etc. at the first time (start of the needle movement), wherein the second parameter g describes the forces which occur during the needle movement, for example spring forces, hydraulic forces, friction, damping, magnetic forces etc.

If the first parameter is known, the second parameter can be calculated analytically. Use is made of the fact that the function y(t) has to be equal to zero at the second time (end of the injection, OPP4):

$$g = \frac{2 \cdot v_{y0}}{t(OPP4) - t(OPP1)}.$$

According to a further exemplary embodiment of the invention, the movement of the nozzle needle during the injection process constitutes essentially a ballistic trajectory.

This exemplary embodiment is consequently concerned with injection times which are so short that the armature and nozzle needle do not strike against the pole piece. In this case, the model is determined by the function described above y(t) completely in the sense that the entire movement of the nozzle needle during the injection is determined by the function y(t).

It is to be noted that the function y(t) can also be used as part of a model if the armature and nozzle needle reach the pole piece, that is to say if the needle movement only partially constitutes a ballistic trajectory. In this case, the function y(t) can be used to calculate boundary conditions for further models or parts of models.

Overall, the methods described above permit simple and precise determination of injection quantities during the actuation of fuel injectors with a solenoid drive. The methods are particularly well suited for ballistic operation and can be used both with fuel injectors with an idle stroke and with fuel injectors without an idle stroke.

According to a second aspect of the invention, a method for actuating a fuel injector having a solenoid drive is described. The described method comprises the following: (a) carrying out a method for determining the injection quantity of the fuel injector according to the first aspect or one of the preceding exemplary embodiments and (b) actuating the fuel injector on the basis of the determined injection quantity, wherein in particular a duration between the application of a boost voltage for opening the fuel injector and the application of a voltage for closing the fuel injector is reduced or increased, if it is determined that the injection quantity is larger or smaller than a reference injection quantity.

With this method, it is possible, by using the method according to the first aspect, to precisely calculate the exact injection quantity in a simple and reliable way and use it to correct the actuation. In particular, the injection quantity can be determined with high precision in the case of short injection times in which the nozzle needle describes a ballistic trajectory.

According to a third aspect of the invention, an engine controller is described for a vehicle, which engine controller is configured to perform a method according to the first aspect, second aspect and/or one of the above exemplary embodiments.

This engine controller makes it possible, by using the method according to the first aspect, to achieve a precise determination of the actual injection quantity of the individual fuel injectors in a simple and reliable way and, if appropriate, to correct said injection quantity.

According to a fourth aspect of the invention, a computer is described which, when it is executed by a processor, is designed to carry out the method according to the first aspect, the second aspect and/or one of the above exemplary embodiments.

According to this document, the designation of such a computer program is equivalent to the term program element, computer program product and/or computer-readable medium, which contains instructions for controlling a computer system, in order to suitably coordinate the mode of operation of a system or of a method, in order to achieve the effects which are linked to the method according to the invention.

The computer program can be implemented as a computer-readable instruction code in any suitable programming language such as, for example, in JAVA, C+++ etc. The computer program can be stored on a computer-readable storage medium (CD Rom, DVD, Blu-ray disk, disk drive, volatile or non-volatile memory, installed memory/processor etc.). The instruction code can program a computer or other programmable devices such as, in particular, a control unit for an engine of a motor vehicle in such a way that the desired functions are executed. In addition, the computer program can be made available in a network such as, for example, the Internet, from which it can be downloaded by a user when necessary.

The invention can be implemented both by means of a computer program, i.e. a software package, and by means of one or more specific electric circuits, i.e. using hardware or using any desired hybrid form, i.e. by means of software components and hardware components.

It should be noted that embodiments of the invention have been described with reference to different subjects of the invention. In particular, some embodiments of the invention are described by way of method claims and other embodiments of the invention are described by way of apparatus claims. However, it becomes immediately clear to a person skilled in the art upon reading this application that, unless explicitly stated otherwise, in addition to a combination of features which are associated with one type of subject matter of the invention, any combination of features which are associated with different types of subjects of the invention is also possible.

Further advantages and features of the present invention can be found in the exemplary description of a preferred embodiment which follows.

DETAILED DESCRIPTION

It should be noted that the embodiments described below are merely a limited selection of possible variant embodiments of the invention.

Figure 1:
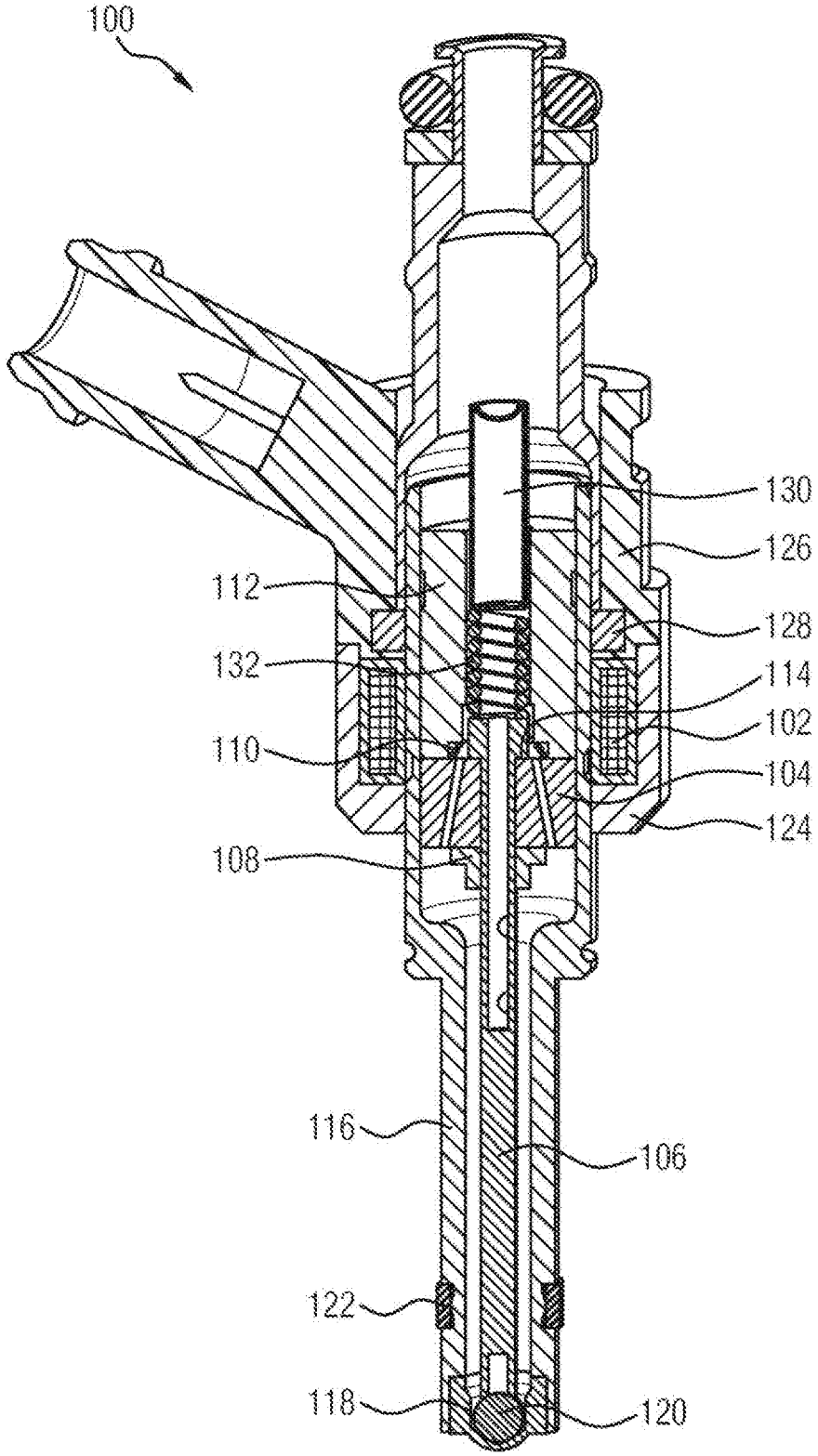
FIG. 1 shows a sectional view of a fuel injector with a solenoid drive.

FIG. 1 shows a sectional view through a fuel injector 100 with a solenoid drive (solenoid injector). The injector 100 has, in particular, a solenoid drive with coil 102 and armature 104. If a voltage pulse is applied to the coil 102, the magnetic armature 104 moves in the direction of the wide part of the nozzle needle 106 and then forces it upward, after overcoming the idle stroke 114 (counter to the force of the spring 110), counter to the spring forces applied by the springs 110 and 132 until the armature 104 strikes against the pole shoe 112. After the end of the voltage pulse, the armature 104 and nozzle needle 106 move downward again to the initial position at the hydro-disk 108.

The solenoid injector 100 which is shown in FIG. 1 has a plurality of features which are known as such and are only of minor significance for the present invention, and are therefore not described in detail. These features comprise, in particular, valve bodies 116, an integrated seat guiding means 118, ball 120, seal 122, housing 124, plastic 126, disk 128, metal filter 130 and calibration spring 132.

Figure 2:
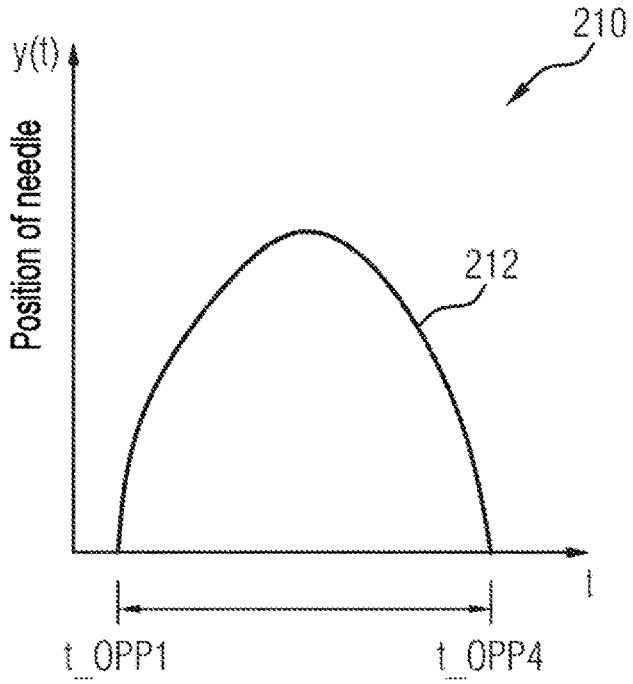
FIG. 2 shows an illustration of the needle position as a function of the time in the case of ballistic operation of a fuel injector.

The present invention is based on the idea of calculating the movement of the nozzle needle of a fuel injector, for example of the fuel injector 100 described above, during the injection process using a model, in order to calculate the actual injection quantity with high precision, and, if appropriate, to correct it during subsequent actuation processes. The model-based calculation of the needle movement, that is to say the needle position as a function of the time, is described below for injections which are so short that the armature 104 and nozzle needle 106 do not strike against the pole shoe. In this case, the needle movement essentially describes a ballistic trajectory. That is to say the needle position is represented as a function of the time, as in the illustration 210 in FIG. 2, follows a parabolic curve 212 and can consequently be modelled with a polynomial of the 2nd order:

$$y(t) = v_{y0} \cdot t - \frac{1}{2} \cdot g \cdot t^2.$$

Here, y(t) denotes the position of the nozzle needle, $v_{y0}$ denotes a first parameter of the model, g a second parameter of the model and t the time.

According to the invention, the first and the second parameter is determined on the basis of the times t_OPP1 and t_OPP4, wherein the first time t_OPP1 corresponds to the start of the needle movement (and therefore to the start of the actual injection process), and the second time t_OPP4 corresponds to the end of the needle movement (and therefore the end of the actual injection process). These two times are preferably determined with suitable methods from the prior art.

Figure 3:
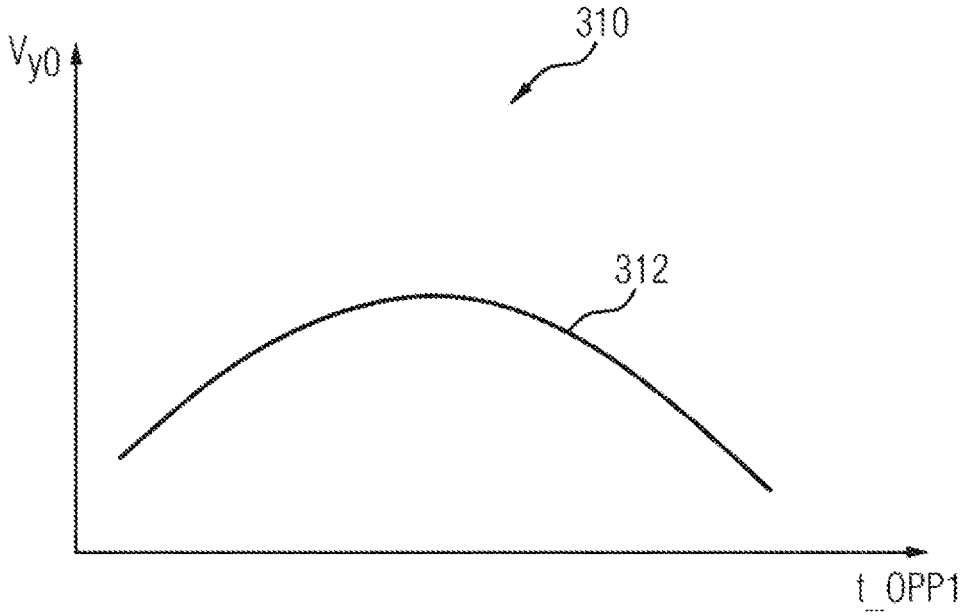
FIG. 3 shows an illustration of the relationship between the start of injection (OPP1) and a model parameter.

In particular, the first parameter $v_{y0}$ is determined on the basis of a relationship with the first time t_OPP1. This relationship is preferably determined by simulation by means of finite element methods (FEM), and is stored in a dataset, for example as a table, in the memory of the engine control unit. FIG. 3 shows an illustration 310 of such a relationship which is determined by simulation and is illustrated as a curve 312.

The second parameter g can then be determined by making use of the fact that the needle position at the end of the injection process (that is to say at the time t_OPP4) must be equal to zero (position of rest of the needle):

$$g = \frac{2 \cdot v_{y0}}{\text{t_OPP4} - \text{t_OPP1}}.$$

If the time axis is defined such that t_OPP1=0, then t_OPP1 is omitted in the above formula.

Figure 4:
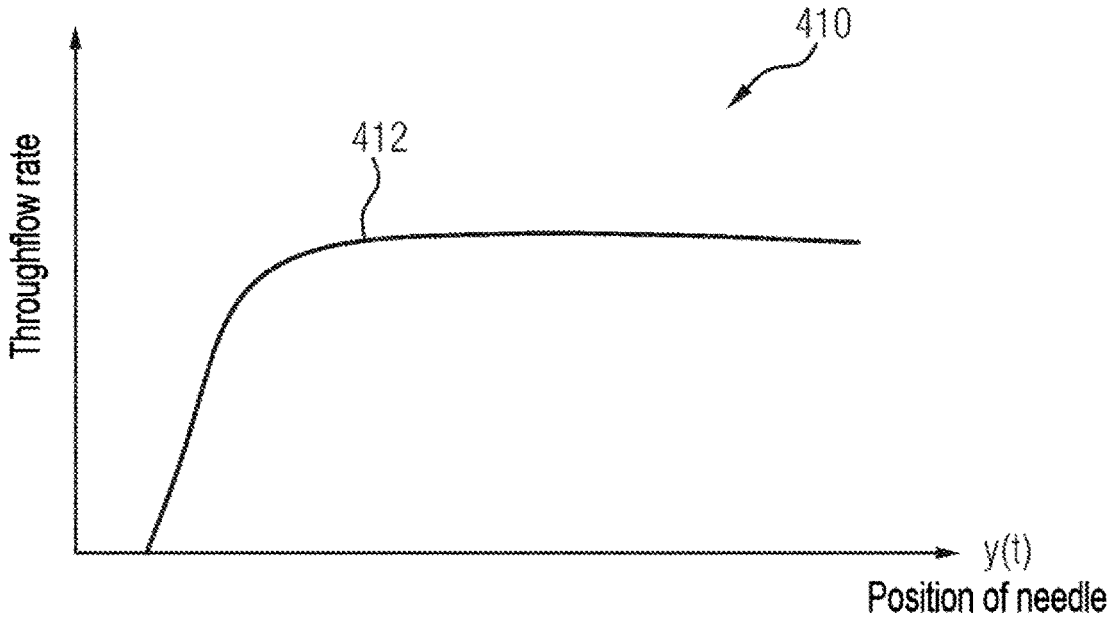
FIG. 4 shows an illustration of the relationship between the needle position and injector through flow rate.

The model, which is now determined for the needle movement is then used together with the through flow characteristic (that is to say the relationship between the through flow rate and the needle position) of the fuel injector, in order to calculate the actual injection quantity by integrating the through flow rate over the injection period (from t_OPP1 to t_OPP4). FIG. 4 shows an illustration 410 of such a relationship 412 between the needle position and the injector through flow rate.

If the calculated injection quantity deviates from the set point quantity or reference quantity, the actuation for the subsequent injection process is correspondingly adapted. If the calculated injection quantity exceeds the set point quantity, the duration of the boost phase can, for example, be correspondingly shortened.

Figure 5:
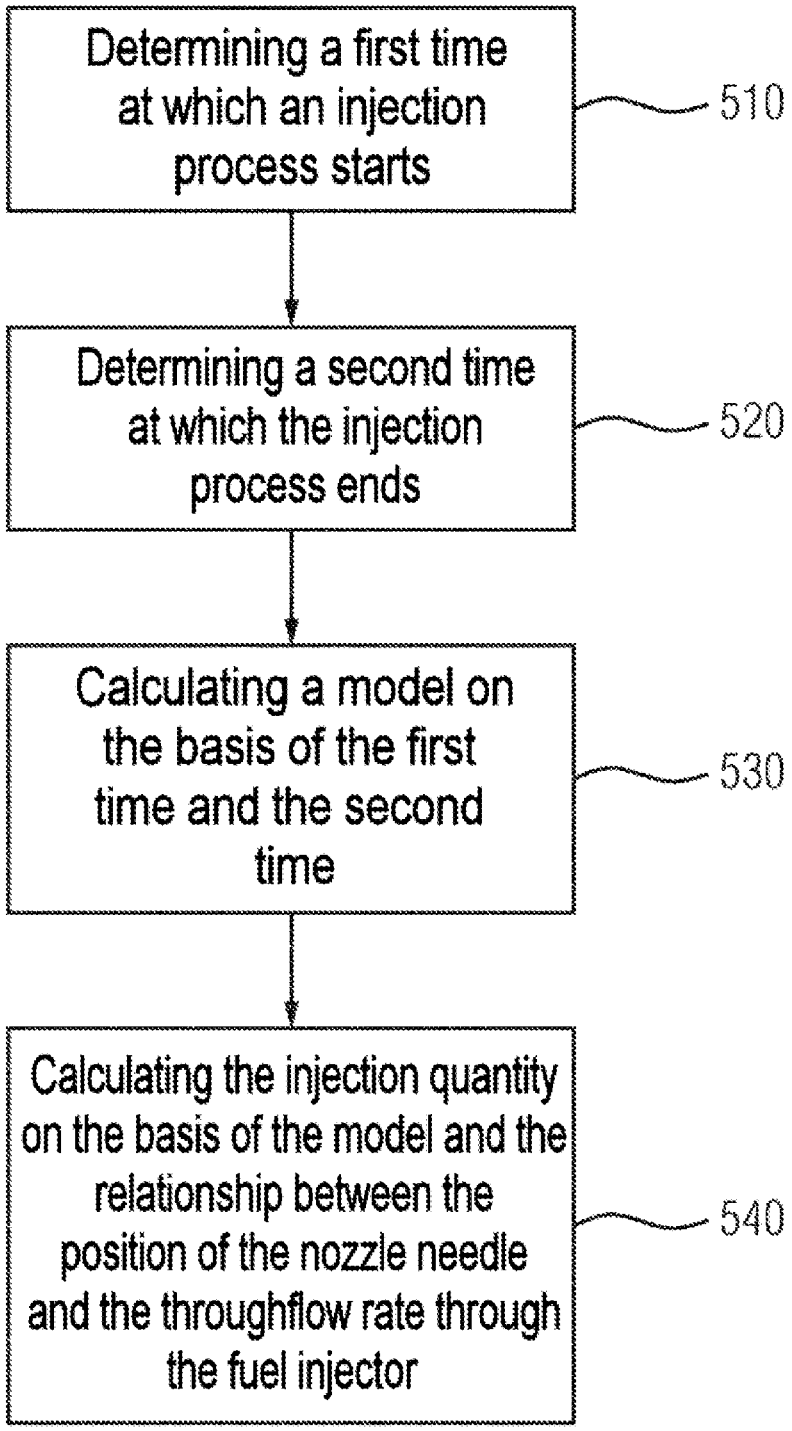
FIG. 5 shows a flowchart of a method according to the invention.

FIG. 5 shows a flowchart which compiles the method according to the invention as described above for determining an injection quantity of a fuel injector 100, having a solenoid drive, for an internal combustion engine of a motor vehicle.

In step 510, the time t_OPP1 (first time) at which an injection process of the fuel injector starts is determined. Then, in step 520, the time t_OPP4 (second time) at which the injection process of the fuel injector ends is determined.

In step 530, a model (for example with the above-mentioned parameters $v_{y0}$ and g), which represents the position y(t) of the nozzle needle 106 of the fuel injector 100 as a function of the time, is calculated.

On the basis of the calculated model and a characteristic relationship between the position of the nozzle needle and the through flow rate of the fuel injector, the precise injection quantity is then calculated in step 540.

The method described above is preferably carried out by means of software in an engine control unit. The actual injection quantity of a fuel injector can then be determined precisely and, if appropriate, used to correct the actuation, without employing additional hardware.

LIST OF REFERENCE NUMBERS

100 Fuel injector
102 Coil
104 Armature
106 Nozzle needle
108 Hydro-disk
110 Spring
112 Pole shoe
114 Idle stroke
116 Valve body
118 Integrated seat guiding means
120 Ball
122 Seal
124 Housing
126 Plastic
128 Disk
130 Metal filter
132 Calibration spring
210 Illustration
212 Curve
t_OPP1 Time
t_OPP4 Time
310 Illustration
312 Curve
$v_{y0}$ Model parameter
410 Illustration
412 Curve
510 Method step
520 Method step
530 Method step
540 Method step

What is claimed is:

1. A method for determining an injection quantity of a fuel injector having a solenoid drive, for an internal combustion engine of a motor vehicle, the method comprising:

determining a first time at which an injection process of the fuel injector starts;

determining a second time at which the injection process of the fuel injector ends;

calculating a model on the basis of the first time and the second time, which model represents a position of a nozzle needle of the fuel injector as a function of the time;

calculating the injection quantity on the basis of the model and a relationship between the position of the nozzle needle and a through flow rate through the fuel injector; and injecting the calculated injection quantity of fuel into the engine.

2. The method as claimed in claim 1, wherein the model has a first parameter and a second parameter, wherein the first parameter is assigned to a linear part of the function, and the second parameter is assigned to a quadratic part of the function.

3. The method as claimed in claim 2, wherein the first parameter of the model is calculated on the basis of predetermined data and the first time.

4. The method as claimed in claim 3, wherein the second parameter is calculated on the basis of the first parameter and at least one of the first time and the second time.

5. The method as claimed in claim 4, wherein the model has the function $$y(t) = v_{y0} \cdot t - \frac{1}{2} \cdot g \cdot t^2,$$

wherein y(t) denotes the position of the nozzle needle, $v_{y0}$ denotes the first parameter, g the second parameter and t the time.

6. The method as claimed in claim 5, wherein the movement of the nozzle needle during the injection process constitutes essentially a ballistic trajectory.

7. A method for actuating a fuel injector having a solenoid drive, the method comprising:

carrying out a method for calculating the injection quantity of the fuel injector as claimed in claim 1, and actuating the fuel injector on the basis of the calculated injection quantity, wherein a duration between the application of a boost voltage for opening the fuel injector and application of a voltage for closing the fuel injector is reduced or increased, if it is determined that the injection quantity is larger or smaller than a reference injection quantity.

8. The method of claim 5, wherein the predetermined data comprises a table stored in memory of a value of the first parameter for each of a plurality of time values corresponding to the first time, and calculating the model comprises calculating the first parameter by using the table to identify the value of the first parameter corresponding to the determined first time.

9. The method of claim 8, wherein calculating the model comprises calculating the second parameter by using the function y(t), the calculated first parameter, the determined second time and the determined first time.

10. The method of claim 4, wherein the predetermined data comprises a table stored in memory of a value of the first parameter for each of a plurality of time values corresponding to the first time, and calculating the model comprises calculating the first parameter by using the table to identify the value of the first parameter corresponding to the determined first time.

11. The method of claim 10, wherein calculating the model comprises calculating the second parameter by using the function, the calculated first parameter, the determined second time and the determined first time.

12. A computer program for actuating a fluid injector having a solenoid drive, the computer program stored in non-transitory memory and having instructions, which when executed by a processor, performs determining a first time at which an injection process of the fluid injector starts;

determining a second time at which the injection process of the fluid injector ends;

calculating a model on the basis of the first time and the second time, which model represents a position of a nozzle needle of the fluid injector as a function of the time;

calculating an injection quantity on the basis of the model and a relationship between the position of the nozzle needle and a through flow rate through the fluid injector; and injecting the calculated injection quantity of fluid from the fluid injector.

13. The computer program of claim 12, wherein the model has a first parameter and a second parameter, wherein the first parameter is assigned to a linear part of the function, and the second parameter is assigned to a quadratic part of the function.

14. The computer program of claim 13, wherein the first parameter of the model is calculated on the basis of predetermined data and the first time.

15. The computer program of claim 14, wherein the second parameter is calculated on the basis of the first parameter and at least one of the first time and the second time.

16. The computer program of claim 15, wherein the predetermined data comprises a stored table of a value of the first parameter for each of a plurality of time values corresponding to the first time, and the first parameter is calculated by the computer program by using the table to identify the value of the first parameter corresponding to the determined first time.

17. The computer program of claim 16, wherein the second parameter is calculated by the computer program by using the function, the calculated first parameter, the determined second time and the determined first time.

18. The computer program of claim 15, wherein the model has the function $$y(t) = v_{y0} \cdot t - \frac{1}{2} \cdot g \cdot t^2,$$

wherein y(t) denotes the position of the nozzle needle, $v_{y0}$ denotes the first parameter, g the second parameter and t the time.

19. The computer program of claim 18, wherein the predetermined data comprises a stored table of a value of the first parameter for each of a plurality of time values corresponding to the first time, and the first parameter is calculated by the computer program by using the table to identify the value of the first parameter corresponding to the determined first time.

20. The computer program of claim 19, wherein the second parameter is calculated by the computer program by using the function, the calculated first parameter, the determined second time and the determined first time.

21. The method of claim 2, wherein the first parameter of the model is calculated on the basis of predetermined simulation data and the first time.

* * * * *